US010906078B2

(12) United States Patent
Cramer et al.

(10) Patent No.: US 10,906,078 B2
(45) Date of Patent: Feb. 2, 2021

(54) APPARATUS FOR WINDING UP A METAL STRIP

(71) Applicant: SMS group GmbH, Düsseldorf (DE)

(72) Inventors: Ulrich Cramer, Attendorn (DE); Thomas Holzhauer, Kirchhundem (DE); Andreas Kastner, Kirchhundem (DE); Heinz-Adolf Müller, Wilnsdorf (DE); Christian Mengel, Siegen (DE); Janina Weber, Hilchenbach (DE)

(73) Assignee: SMS group GmbH, Düsseldorf (DE)

( * ) Notice: Subject to any disclaimer, the term of this patent is extended or adjusted under 35 U.S.C. 154(b) by 513 days.

(21) Appl. No.: 15/534,742

(22) PCT Filed: Dec. 8, 2015

(86) PCT No.: PCT/EP2015/078928
§ 371 (c)(1),
(2) Date: Jun. 9, 2017

(87) PCT Pub. No.: WO2016/091855
PCT Pub. Date: Jun. 16, 2016

(65) Prior Publication Data

US 2017/0348747 A1 Dec. 7, 2017

(30) Foreign Application Priority Data

Dec. 10, 2014 (DE) ..... 10 2014 225 414
May 22, 2015 (DE) ..... 10 2015 209 462
Nov. 6, 2015 (WO) ..... PCT/EP2015/075873

(51) Int. Cl.
*B21C 47/06* (2006.01)
*B21C 47/34* (2006.01)
*B21C 47/26* (2006.01)

(52) U.S. Cl.
CPC ..... *B21C 47/063* (2013.01); *B21C 47/26* (2013.01); *B21C 47/3433* (2013.01); *B21C 47/3441* (2013.01)

(58) Field of Classification Search
CPC ..... B21C 47/02; B21C 47/04; B21C 47/045; B21C 47/06; B21C 47/063; B21C 47/08;
(Continued)

(56) References Cited

U.S. PATENT DOCUMENTS 2,739,763 A * 3/1956 Silfverlin ..... B21C 47/04 72/148
3,805,570 A * 4/1974 Smith ..... B21B 1/26 72/146
(Continued)

FOREIGN PATENT DOCUMENTS

DE 927085 C 4/1955
EP 2038076 B1 3/2010
(Continued)

OTHER PUBLICATIONS

Translation of WO 2009097957 A1—Robert Minichmayr—Aug. 2009—(Year: 2009).*
(Continued)

*Primary Examiner* — Debra M Sullivan
*Assistant Examiner* — Matthew Kresse
(74) *Attorney, Agent, or Firm* — Maier & Maier, PLLC

(57) ABSTRACT

An apparatus for winding up a metal strip into a coil. A frame in which a second counter-bending roller is mounted in a rotatable manner. The frame is movable with the aid of a second setting device between a coiler shaft position and a roller bed position. In the roller bed position, the second counter-bending roller alongside a first counter-bending roller acts as the roller bed roller of a roller bed which is arranged above the coiling device.

14 Claims, 4 Drawing Sheets

(58) Field of Classification Search
CPC ..... B21C 47/10; B21C 47/12; B21C 47/14; B21C 47/28326; B21C 47/3433; B21C 47/3441; B21C 47/28; B21C 47/326; B21C 47/00; B21C 47/006; B21C 47/066; B21C 47/24; B21C 47/26; B21C 47/32; B21C 47/34; B65H 18/00; B65H 18/02; B65H 18/04; B65H 18/08; B21D 1/05
USPC ..... 72/161
See application file for complete search history.

(56) References Cited

U.S. PATENT DOCUMENTS 4,530,224 A * 7/1985 Hild ..... B65H 18/10 242/566
7,410,117 B2 * 8/2008 Klein ..... B21C 47/34 242/534.1
2009/0184191 A1 7/2009 Müller et al.
2010/0083720 A1 * 4/2010 Hackenberg ..... B21C 47/345 72/8.6

FOREIGN PATENT DOCUMENTS

JP S428114 Y1 4/1967
JP 2010264493 A 11/2010
WO WO-2009097957 A1 * 8/2009 ..... B21C 47/003

OTHER PUBLICATIONS

International Search Report dated Feb. 10, 2016 of corresponding International application No. PCT/EP2015/078928; 7 pgs.
Written Opinion dated Feb. 10, 2016 of corresponding International application No. PCT/EP2015/078928; 5 pgs.

* cited by examiner

APPARATUS FOR WINDING UP A METAL STRIP

FIELD

The invention relates to an apparatus for winding up a metal strip into a coil.

BACKGROUND

Such an apparatus is essentially known from prior art, for example the one shown in FIG. 4. In the apparatus shown in the figure, a strip 210 is guided in the direction indicated by the arrow via a roller bed to a driver device 120 which has the form of a pair of driver rollers. While being driven or conveyed by the pair of driver rollers 120, the strip 210 is guided by a coil shaft 115 to a coil device 110 and winded up therein onto a coil mandrel. The coil shaft 115 is formed on its upper side with a switch 180 which is rotatably mounted about a fixed axis of rotation X. An upper coil shaft flap or an upper guide plate 163 is also rotatably mounted about the same axis of rotation. A shaft roller 162 is rotatably mounted at the end of the upper guide plate 163 opposite the rotational axis X, so that the axis of rotation of the shaft roller 162 runs parallel to the axis of rotation X. The lower side of the coil shaft 115 is formed with various conductive baffle plates.

From European Patent Publication EP 2 038 076 B1 is known an apparatus for winding up a metallic strip, wherein the apparatus is provided with a coil mandrel for winding up the strip and with a strip transport device having the form of a pair of a drive rollers arranged upstream of the strip for conveying the strip into the coil device. Between the driver device and the coil device is arranged a bending device consisting of a first and of a second counter-bending roller for supporting the strip on its path to the coiling device on the upper side, and further including also a bending roller that engages on the lower side of the trip. Both counter-bending rollers as well as the actual bending roller are respectively adjustable to the strip before it enters into the coiling device. The counter-bending rollers as well as the actual bending roller are used to apply a bending moment to the strip as soon as a certain residual length of the strip is reached. Due to the plastic deformation of the band achieved in this manner, an improved system is obtained with respect to the end of the strip in the wound coil.

When the bending device is installed with both counter-bending rollers and with the actual bending roller as separate structural units between the driver device and coiling device, a large amount of space is required, which is often not available in a structurally narrow zone of the coiling shaft. Moreover, the integration of the additional components required for the bending device often results in an increase of the distance between the driver device and the coiling device. Such an increase of the distance is undesirable because the unguided strip position can result in an undesirable "upheaval" during the threading.

SUMMARY OF THE DISCLOSURE

The object of the invention is to further develop a known apparatus for winding up a metal strip into a coil in such a way that the integration of the bending device between the driver device and the coiling device is carried out in a manner that is space-saving and cost-saving as much as possible.

This object is achieved with the subject matter of claim 1, which is characterized in that the first counter-bending roller is mounted in a rotatable but fixed manner as a roller bed roller of a roller bed running above the coiling device; wherein the second counter-bending device is rotatably mounted; a swivel joint is provided for coupling the second adjusting device to the frame; and the control device is further designed for pivoting the frame with the second counter-bending roller between a coiling shaft position and a roller bed position, in which the second counter-bending roller is arranged next to the first counter-bending roller as a roller bed roller of the roller bed of the device.

Both the coiling shaft position and the roller bed position and all other adjustment positions of the frame in between are bending positions in the sense that in all of these positions—with a corresponding adjustment of the bending roll from below—a strip that is guided between both counter-bending rollers and the binding roller can be bent.

With the double function of the second counter-bending roller according to the invention, wherein it serves once as a counter-bending roller for bending the metal strip, and the second time as a driver roller in an already available roller bed which is arranged above the coiling device, the additional costs, such as providing a complete and separate bending device, can be avoided. In addition, this concept is at the same time a space-saving concept because as an alternative to the requirements for the second counter-bending roller, which is formed so that it is connected with the first counter-bending roller of the complete upper part of the bending device, a complete bending device would have to be provided with two separate upper counter-bending rollers below the roller bed, which would necessarily lead to a significant extension of the coiling shaft and thus to an undesirable increase of the coiling shaft and therefore also to an undesirable increase of the distance between the driver device and of the coiling device. With the claimed use of the roller bed rollers as the first and second counter-bending rollers, the additional/separate bending device is avoided, so that the costs can be lowered with a space-saving design.

According to a first embodiment, both the bending roller and the second counter-bending roller, and optionally also the first counter-bending roller, are rotationally driven by means of the drive device in order to convey the strip in the direction of the coiling device during the bending process.

The control device is designed to control the second driving device in such a way that the second counter-bending roller is driven to convey the strip in the coiling position, and to convey it in the position of the roller bed in the opposite rotational direction. The driving in the different rotational direction is required for the second counter-bending roller because the metallic strip—when the counter-bending roller function in its retracted position as a roller bed roller—runs on the upper side of the roller bed and, in contrast to that, when the second counter-bending roller is in its bending position, the metal strip runs along the underside of the opposite bending roller. Using the drive in the opposite rotational direction thus ensures that the strip is constantly conveyed away from the driver device, regardless of whether the counter-bending roller is located in the position of the roller bed, or in the bending position.

According to another embodiment, the apparatus is characterized by a switch determining the direction for the pair of driver rollers that is pivotally mounted in the direction of the axis of rotation of the switch. The axis of rotation of the switch preferably coincides with the axis of rotation of the first counter-bending roller, which is to say along with the axis of rotations of the first roller bed roller. A third adjusting device is used for the adjustment of the switch. The control device is further configured in such a way that the switch is placed by means of the third adjusting device either into a coiling inlet position, in which the strip enters into the coiling device, or into a transfer position, in which the strip is positioned above the roller bed and thus guided away above the coiling device.

In a first operating state, also referred to as strip threading, the switch is positioned by means of the control device into the coil inlet position. The control device is in this case designed to pivot the frame by means of the second adjusting device in its coiling shaft position, and to pivot the bending roller by means of the first adjusting device to its retracted position for forming and releasing a coiling shaft when the beginning of the strip is wound up onto the coiling device.

During the threading of the beginning of the strip:

the pressure rollers are placed around the coiling mandrel;

the driver roller is lowered onto a preset roller gap so that a frictional engagement with the strip to be threaded will be created in every case;

the switch is adjusted for the driver roller in order to deflect the beginning of the strip downward for the coiling shaft;

the frame is lowered with the second baffle plate, with the second counter-bending roller, and with the first baffle plate, to the coiling shaft position; and the bending roller is brought to its threading position, which is to say to its retracted position, so that it forms the lower part of the coiling shaft together with the lower baffle plate.

The frame then forms, together with the switch, the upper part of the coiling shaft. The roller bed is in this operating state interrupted because the second counter-bending roller is pivoted away.

During the threading of the strip, the advancement of the beginning of the strip into the coiling shaft takes place by means of the driver device. The bending roller as well as the first and the second counter-bending roller are preferably all driven. The beginning of the strip is guided by means of the upper and lower baffle plate, and supported by the counter-bending rollers and the actual bending roller, to the coiling mandrel, where it is coiled, with the support of the coiling shaft roller and of the pressure roller of the coiling device, around the rotating coiling mandrel.

In a second operating state of the device, also referred to as unthreading of the strip, the switch is also positioned in the coiling shaft by means of the control devices.

The control device is then further configured for pivoting the frame by means of the second adjusting device into a bending position depending on the actual diameter of the strip, as well as to pivot the bending roller by means of the first adjusting device in its bending position. However, the second operating state, in which the strip is bent, does not take place until a predetermined residual length of, for example, 20 m of the strip has been created for winding it up onto the coiling device.

In this operating state, the relevant structural modules are adjusted according to the ready-for-winding strip diameter in order to ensure that the bending of the end of the strip will take place approximately tangentially to the surface of the strip. This means that the respective bending positions of the bending roller and of both counter-bending rollers can vary depending on the actual diameter of the strip.

During the unthreading of the end of the strip:

all the stationary switch rollers or the first counter-bending roller are positioned together with the switch (unchanged) in the position for entering the coiling operation;

the frame position is adjusted together with both baffle plates and with the second counter-bending roller to a bending position, which is determined by the outer diameter of the strip;

the bending roller is also brought into the bending position, wherein this position is determined not only by the outer diameter of the strip, but to the same extent also by the desired bending conditions, which is to say in particular by the required bending diameter and by the required bending force; and the calculation of the position for adjusting the bending position and of the adjusting forces for the second counter-roller and for the actual bending roller is carried out with a suitable computer program.

During the bending of the end of the strip, the bending rollers and both counter-bending rollers are also guided synchronously and thus create the desired bending, which is to say the desired plastic deformation of the end of the strip. The end of the strip is at the same time guided to the coil surface.

In a third operating state of the device, the switch is positioned for the transfer position by means of the control device. The control device is then further also configured to pivot the frame by means of the second adjusting device in its roller bed position, in which the second counter-bending roller is arranged next to the first counter-bending roller as a roller bed roller of the roller bed of the device.

The first adjusting device is preferably connected to the bending roller via a multi-articulated coupling gear. The advantage of the fact that a multi-articulated coupling gear is that the bending roller can be moved on a specified travel path between its bending position and its retracted position. This travel path is defined and limited by numerous structural elements, which are arranged in this region. The multi-articulated coupling gear is configured in such a way that the bending roller does not collide during the process between the bending position and the retracted position with other components or interfering edges.

Since a first baffle plate is provided between the second and the first counter-bending roller in the frame as an upper cover of the coiling shaft between convexly curved second first baffle plate and second baffle, which is placed in the transport direction between the counter-bending roller and the coiling shaft roller in the frame as another upper cover of the coiling shaft, this provides the advantage that the metal strip is thus guided into the coiling device in an optimal manner, in particular when it enters at its beginning the coiling shaft when it is not yet gripped by the coiling device.

The control device is configured in such a way that the first and the second adjusting device—wherein with the latter, the frame is provided with the second counter-bending roller—can control the position and/or also control the force. The position control is required to position the bending direction, in particular the bending roller and the second counter-bending roller, in such a way that the metal strip leaves these two rollers positioned approximately tangentially based on the individual diameter of the strip. The required bending force and the respective position of the rollers are determined by the thickness of the strip, the temperature and the deformation resistance and thus also by the predetermined bending radius, with which the end of the strip will be impacted by means of the bending device.

BRIEF DESCRIPTION OF THE DRAWINGS

These and other advantageous embodiments of the invention are the subject matter of the dependent claims.

The description is accompanied by 4 figures, which show the following

DETAILED DESCRIPTION

The invention will next be described in detail in the form of embodiments with reference to FIGS. 1 through 3. The same technical elements are labeled with the same reference symbols in all of the figures.

Figure 1:
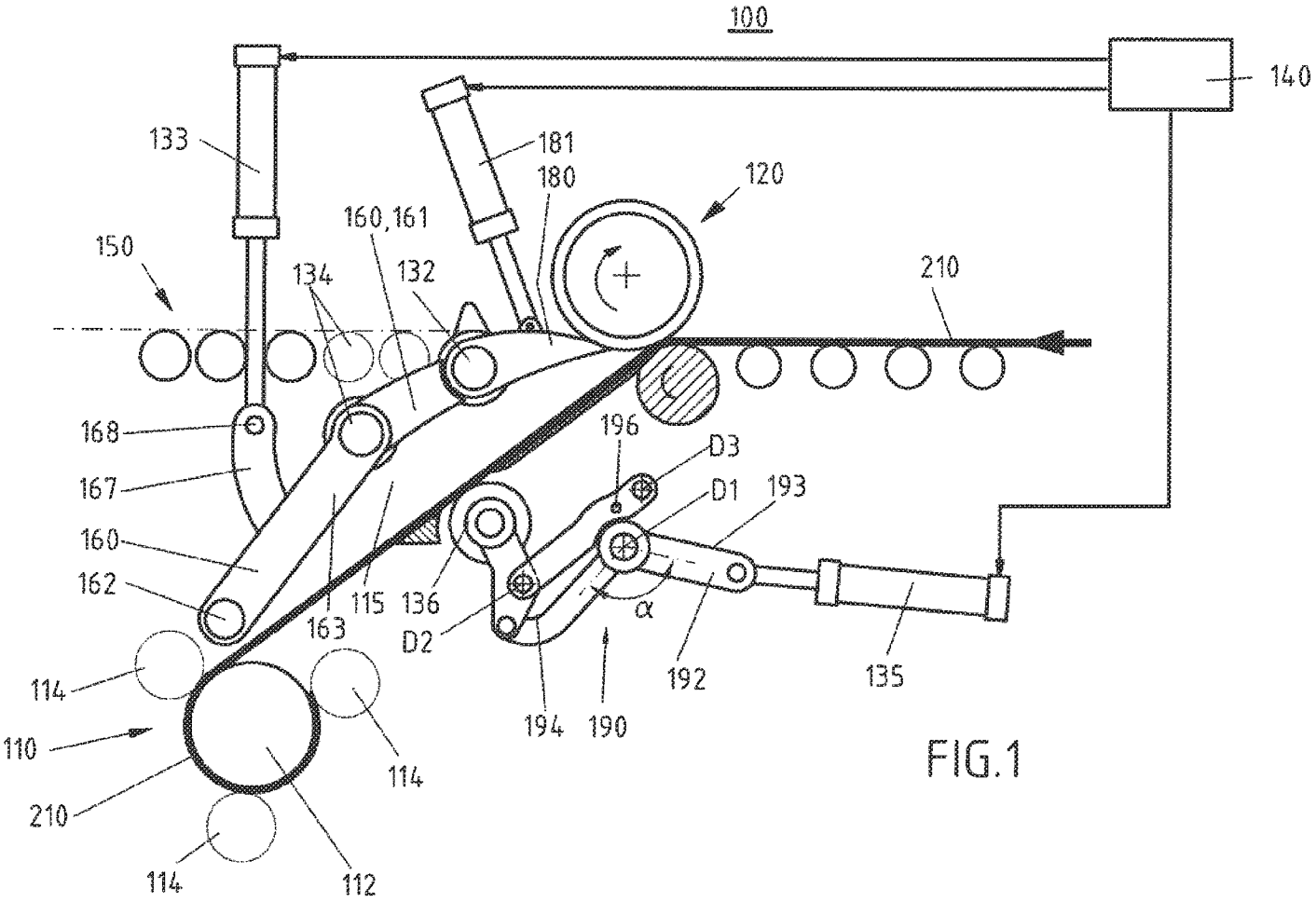
FIG. 1 the device according to the invention in a first operating state for forming and releasing a coiling shaft.
Figure 3:
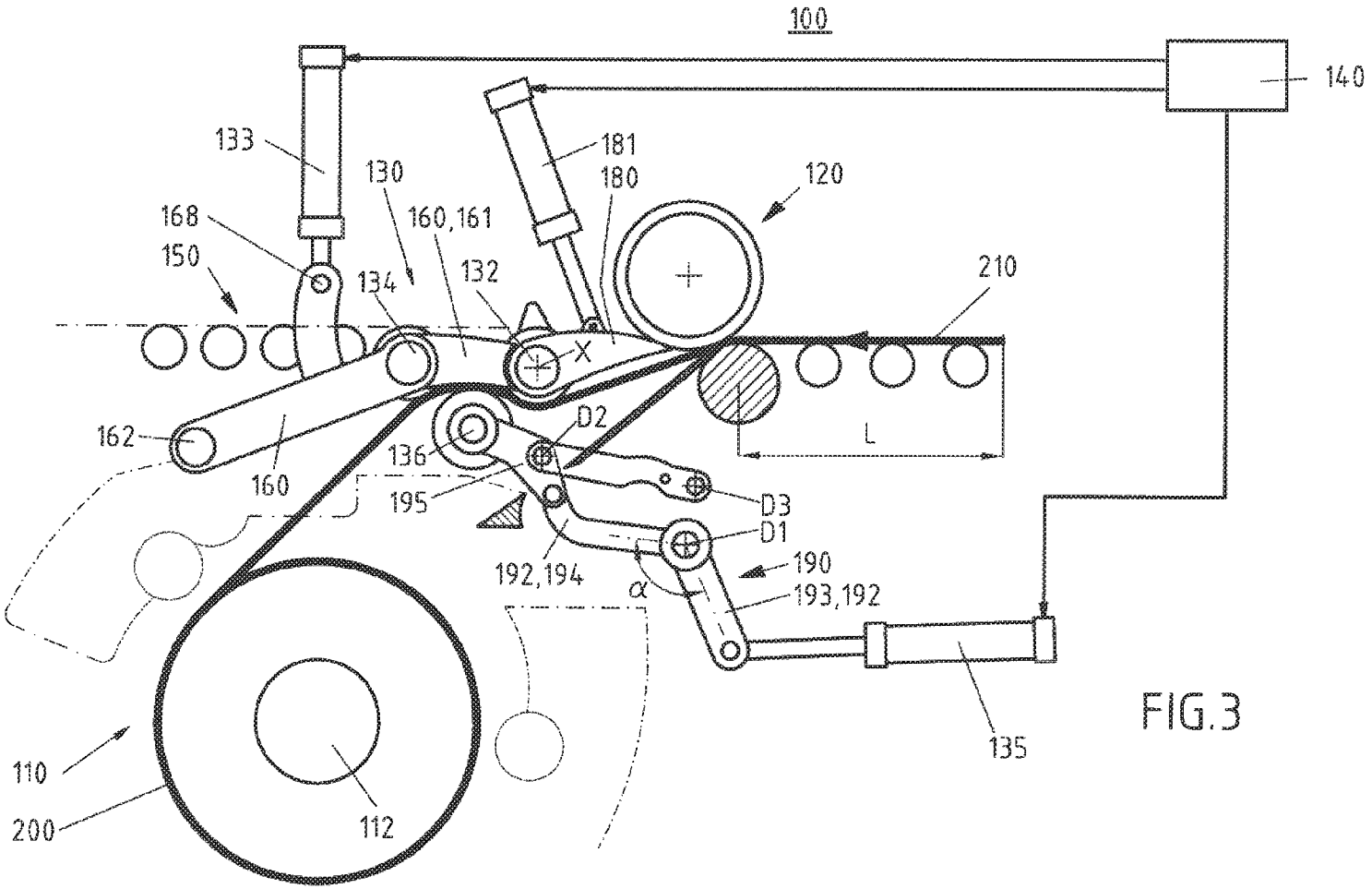
FIG. 3 the device according to the invention in a second operating state for applying a bending moment to the end of the strip, and FIG. 4 a device for winding up a metal strip to a coil according to prior art.

FIG. 1 shows an apparatus 100 according to the invention for winding up a metal strip 210 to a coil 200, see FIG. 3. The device 100 comprises a coiling device 110 that is provided with coiling mandrel 112, onto which the metal strip 210 is wound up. This strip 210 is pressed onto the coiling mandrel 112 by means of the pressure rollers 114.

The apparatus 100 is further provided with a driver device 120 mounted upstream of the coiling device 110 seen in the transport direction of the strip 210 (the direction of the arrow in FIG. 1) for conveying the strip 210 in the coiling device 110. The driver device 120 according to FIG. 1 comprises a pair of driver rollers, of which at least one driver roller is rotatably driven. Between the driver device 120 and the coiling device 110 is arranged a bending device 130 for applying a bending moment to the end of the metal strip to be wound up as soon as a residual length of for example 20 m has been created for winding it on the coiling mandrel. The bending device 130 is provided with a first counter-bending roller 132, with a second counter-bending roller 134, as well as with an actual bending roller 136. The second counter-bending roller 134 is rotatably mounted on a frame 160 downstream of the first counter-bending roller 132. Both counter-bending rollers act on the upper side of the metal strip, while the bending roller 136 acts on the lower side of the metal strip. The bending roller 136 is connected via a multi-articulated coupling gear 190 to the first adjusting device 135. The frame 160 and thus also the second counter-bending roller 134 are connected via a lever arm 167 to a second adjusting device 133.

The frame 160 is provided with a coiling shaft 162 on its end that is assigned to the coiling device 110 and it is rotatably mounted on its end opposite the coiling shaft roller, preferably on the rotational axis of the first counter-coiling roller 132.

The second counter-bending roller 134 is rotatably mounted between the coiling shaft roller 162 and the first counter-bending roller 132 parallel to both above-named rollers on the frame 160. A first baffle plate 161 is provided between the first counter-bending roller 132 and the second counter-bending roller 134 on the frame 160, and a second baffle plate is provided on the frame 163 in the region between the second counter-bending roller 134 and the coiling shaft roller 162.

It is preferred when a switch 180 is also rotatably mounted on the axis of rotations X of the first counter-bending roller 132, which is tapered off or tapers off in the direction of the driver device 120. The switch can be moved by means of the control device and of a third adjustment device 181 into a transfer position, in which the metal strip 210 is guided as it exits from the driver device 120 to a roller 150 arranged above the coiling device 110. Alternatively, the switch can be pivoted by means of the control device and of the third adjusting device 181 into the coiling inlet position shown in FIG. 1. The lower side of the switch 180 then forms together with the pivoted frame shown in FIG. 1, which is pivoted to its reeling shaft position, an upper cover for the coiling shaft 115, through which the metal strip 210 is guided to the coiling device 110. In particular, at the beginning of the threading operation when no tensile stress is exerted yet with the coiling device 110 and the driver device 120 on the strip 210, it is advantageous that the beginning of the strip is formed by sliding it along the lower side of the switch 180, as well as on the lower side of the first and second baffle plate 161, 163 toward the coiling device 110. While the strip operation is started and the fillet of the metal strip is wound up on the coiling device 110, the frame 160 is located in the position of the coiling shaft shown in FIG. 1 in which the coiling shaft 115 is tensioned and released. While the upper cover of the coiling shaft 115 is formed, as was already mentioned, by the lower side of the switch and the lower side of the frame 160 and the baffle plates 161 and 163, the lower cover of the coiling shaft is formed by various lower baffle plates. The bending roller 136 does not belong to the upper cover of the coiling shaft. The bending roller 136 is, during this time, moved back by means of the first adjusting device 135 to its retracted position shown in FIG. 1. In this retracted position, the bending roller 136 does not project into the coiling shaft.

Figure 2:
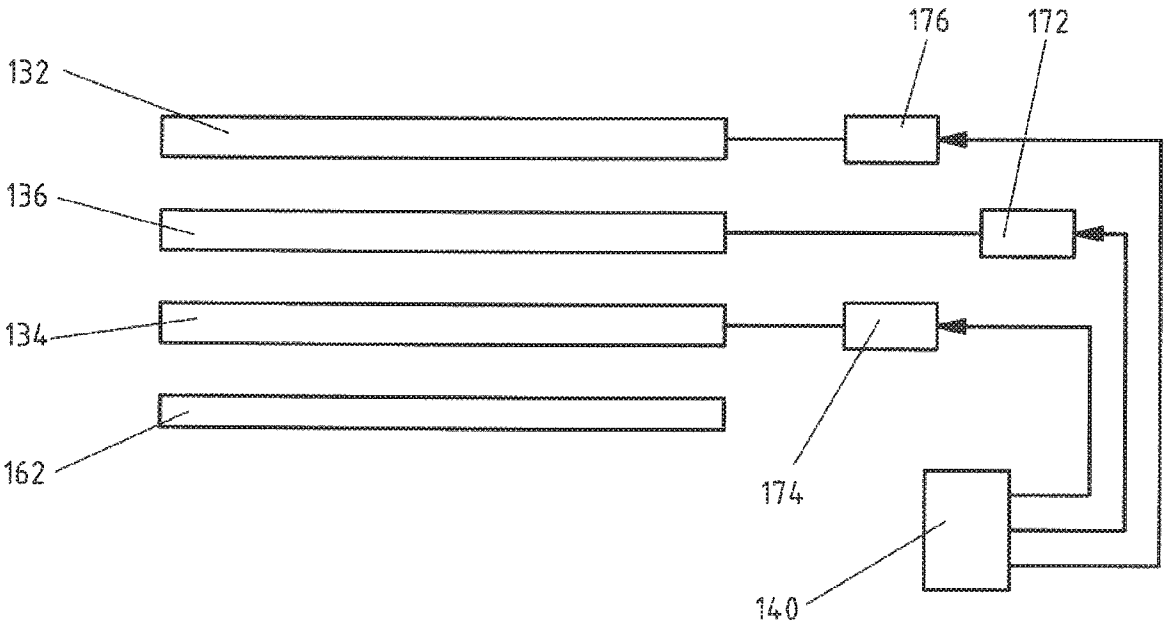
FIG. 2 the drive device for the first counter-bending roller, the second counter-bending roller, and the bending roller.

FIG. 2 shows a top view of the rollers of the upper shaft 115, seen in the transport direction of the metal strip, with the first counter-bending roller 132, the bending roller 136, the second counter-bending roller 134 and with the coiling shaft roller 162, with their respective drive devices 172, 174, 176, when they are available.

The configuration of the device 100 is shown in FIG. 1 with the positioning of the switch 180 in the coiling inlet position, with the position of the frame 160 and of its rollers mounted thereupon in the coiling, and with the bending roller in its retracted position is referred to as the first operating state of the device 100. In this first operating state, the coiling shaft 115 is realized in order to wind up the beginning of the fillet of the strip 210 onto the coiling device 110.

The control required for the first, second and third adjusting device 133, 135 and 181 for the positioning of the switching 180, of the frame 160 and of the bending roller 136 is in said positions carried out with a drive device 140, which controls in a suitable manner also the drive devices 172, 174, and 176.

In a second operating state of the device 100, the switch remains in its coiling inlet position as before, but the frame 160 as well as the bending rollers 136 are positioned in their respective bending positions. In this second operating state, the bending state is influenced by the cooperation with the bending roller 136 exerting a bending moment on the strip 210 to be wound up, but only after a predetermined residual length of for example 20 m has been created for winding up the strip on the coiling device 110.

Figure 4:
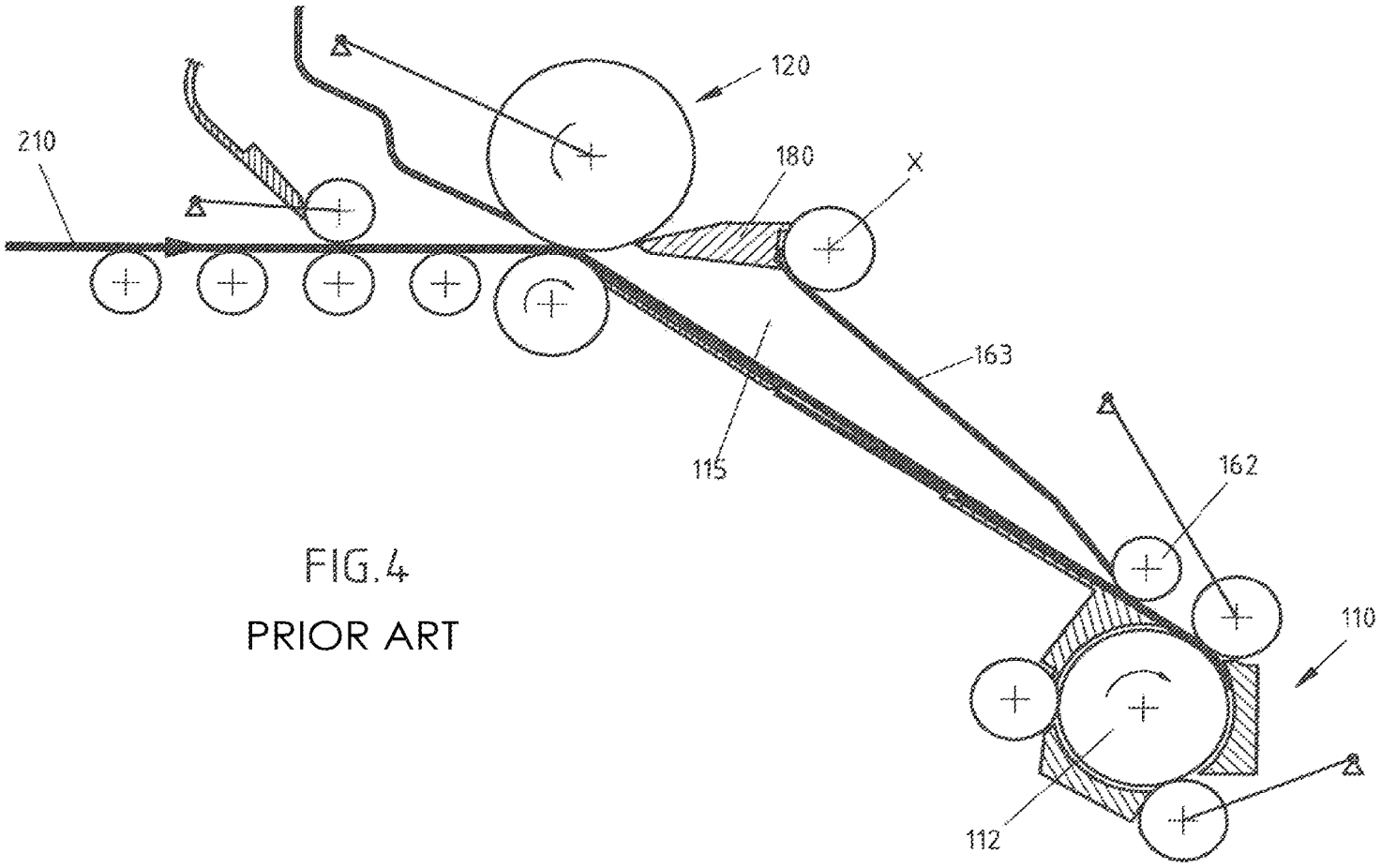
FIG. 4 PRIOR ART

FIG. 3 shows an example of the second operating state, for example of the bending state. In the concrete example shown in the figure, the frame 160 is returned back to its bending position with the aid of the second adjusting device 133 and by means of the control device 140. The bending position shown in FIG. 4 corresponds to the roller bed position with a correspondingly greater strip diameter. In this position, the second counter-bending roller 134 is arranged at the height of the roller bed 150, although this roller bed is not used per se for transferring the strip in this operating state. In order to exert the bending moment onto the strip 210, the bending roller 136 is driven by means of the first adjusting device 135 and by means of the multi-articulated coupling gear 190 all the way below the first baffle plate 161 into the coiling shaft 115 in order to apply force on the lower side of the metal strip 210. The bending positions of the frame 160 and of the bending roller 136 shown in FIG. 3 are used only by way of an example. Any possible adjusting position of the frame between the coiling shaft position and the roller bed position is in fact suitable as bending positions because in each of these positions, the bending roller 136 can be placed against the metal strip in order to exert a bending moment on the strip.

The multi-articulated coupling gear is provided with a stationary main axis of rotation D1, which extends parallel to the first and to the second counter-bending roller 132, 134 in the direction of the width of the strip 210. An angle lever 192 is rotatably mounted about the stationary main axis of rotation Dl. The angle lever 192 is provided with at least one force arm 193, which is preferably centrally arranged and on whose end is engaged the first adjusting device 135 on the opposite end, as well as with two load arms 194, wherein each load arm forms angle α with the force arm. Furthermore, two extended levers 195 that are arranged in the mirror-image form are provided, which are rotatably articulated at the opposite ends of the load arms 194 of the angle lever 192, which carry and rotatably support with their other end the binding roller 136, and which are respectively equipped with a pivot point D2 that is located between the bending roller 136 and the articulation on the load arm 194 of the angle lever 192. Finally, two mirror-image shaped tabs 196 are rotatably mounted with their other end at a stationary axis of rotation D3, wherein the stationary axis of rotation D3 of the tabs is arranged above the stationary main axis of rotation of the angle lever 192.

In addition to the two operating states shown in FIGS. 1 and 3, there is also a third operating state in which the switch 180 can be positioned—and guided by the control 140—to the transfer position. The frame 160 is then at the same time positioned by means of the second adjusting device 130—while also being guided via the control device 140—to the roller bed position shown in FIG. 3, wherein the second counter-bending roller 134 functions as a roller bed roller.

In all three operating states, the strip 210 is moved out of the driver device 120 and it is either wound up on the coiling device 110, or guided via the roller bed 150. It is important that the second counter-bending roller 134, when it functions as a roller bed roller, be driven by its associated second driver device 174 in the opposite direction of rotation, as opposed to the situation when it functions as a counter-bending roller. The opposite direction of rotation is required because the second counter-bending roller 134 comes in its position when it functions as a roller bed roller in contact with the lower side of the strip 210, while when it functions as a second counter-bending roller, it will come into contact with the upper side of the strip 210.

LIST OF REFERENCE SYMBOLS

100 device
110 coiling device
112 coiling mandrel
114 pressure roller
115 coiling shaft
120 driver device
130 bending device
132 first counter-bending roller
133 second adjusting device
134 second counter-bending roller
135 first adjusting device
136 bending roller
140 control device
150 roller bed
160 frame
161 first baffle plate
162 coiling shaft roller
163 second baffle plate
167 lever arm
168 pivot
172 first drive device
174 second drive device
176 third drive device
180 switch
181 third adjusting device
190 multi-articulated coupling gear
192 angle lever
193 force arm
194 load arm
195 extended lever
196 tabs
200 strip
210 strip
X axis of rotation
D1 the first stationary main axis of rotations
D2 pivot point
D3 the second stationary axis of rotations
L residual length
α angle

The invention claimed is:

1. An apparatus for winding up a metal strip on a coil; comprising:

a coiling device provided with a coiling mandrel for winding up the strip;

a drive device, mounted upstream of the coiling device seen in a direction of transport of the strip in order to convey the strip in the coiling device; and a bending device arranged between the drive device and the coiling device, provided with a first counter-bending roller and a second counter-bending roller for supporting the strip in a path of the strip to the coiling device on an upper side of the strip when the apparatus is in a second operating state, and with a bending roller for supporting the strip on a lower side, wherein the first counter-bending roller is mounted upstream of the second counter-bending roller, and wherein the bending device is further provided with a first adjusting device for the bending roller and with a second adjusting device for the second counter-bending roller; and a roller bed arranged above the coiling device and the strip may pass overtop of at least a portion of the roller bed, the roller bed comprising a plurality of roller bed rollers, wherein:

the apparatus is switchable between a first operating state and at least the second operating state;

the bending roller is movable to a bending position via the first adjusting device, in which the strip is bent through cooperation between the first and the second counter-bending rollers, and the bending roller, and wherein the bending roller is movable to a retracted position;

the first counter-bending roller is mounted rotatably but in a fixed manner as one of the plurality of roller bed rollers of the roller bed;

a frame is provided, in which the second counter-bending roller is rotatably mounted;

a swivel joint is provided for coupling the second adjusting device to the frame; and the frame is pivotable with the second counter-bending roller between a non-roller-bed position and a roller bed position, in which the second counter-bending roller is arranged next to the first counter-bending roller as another one of the plurality of roller bed rollers of the roller bed.

2. The apparatus according to claim 1, wherein the second counter-bending roller is rotationally driven in a first direction to convey the strip in the roller bed position in the second operating state; and the second counter-bending roller is rotationally driven in a second direction opposite to the first direction to convey the strip in the roller-bed position in a third operating state.

3. The apparatus according to claim 1, wherein the frame is rotatably mounted about a fixed axis of rotation, which runs parallel to an axis of rotation of the first counter-bending roller, wherein a radial distance of the axis of rotation of the frame from the axis of rotation of the first counter-bending roller does not exceed a predetermined maximum distance.

4. The apparatus according to claim 3, wherein the axis of rotation of the frame coincides with the axis of rotation of the first counter-bending roller.

5. The apparatus according to claim 3, further comprising:

a switch indicating the direction for the strip, which is pivotally mounted about an axis of rotation of the switch;

wherein the axis of rotation of the switch coincides with the axis of rotation of the first counter-bending roller;

a third adjusting device for adjusting the switch;

wherein the switch is swivel-able by means of the third adjusting device either to a coiling inlet position in which the strip enters the coiling device, or to a transfer position in which the strip is guided with a-the roller bed and thus it is directed away with the coiling device.

6. The apparatus according to claim 5, wherein in the first operating state, the switch is swiveled into the coiling inlet position, the frame is pivoted, by means of the second adjusting device, into the non-roller bed position, and the bending roller is pivoted, by means of the first adjusting device, into the retracted position in order to form and release a coiling shaft when a beginning of the strip is wound up on the coiling device.

7. The apparatus according to claim 6, wherein the frame is equipped with a first baffle plate provided as an upper cover of the coiling shaft and disposed between the second and the first counter-bending roller.

8. The apparatus according to claim 7, wherein the first baffle plate is formed convexly curved with respect to the coiling shaft.

9. The apparatus according to claim 7, wherein the frame is provided with a second baffle plate, which is arranged downstream of the upper cover of the coiling shaft and of the second counter-bending roller in the transport direction.

10. The apparatus according to claim 6, wherein in the second operating state, the switch is swiveled into the coiling inlet position and the frame, by means of the second adjusting device, and the bending roller, by means of the first adjusting device, are pivoted into the bending position, wherein at least the pivoting of the bending roller into the bending position only takes place when a predetermined residual length of the strip has been created for winding up the strip on the coiling device.

11. The apparatus according to claim 10, wherein in a third operating state, the switch is swiveled into the transfer position and the frame is pivoted, by means of the second adjusting device, into the roller bed position, and in which the second counter-bending roller is arranged next to the first counter-bending roller as the roller bed roller of the roller bed.

12. The apparatus according to claim 3, wherein the first adjusting device is connected via a multi-articulated coupling gear with the bending roller.

13. The apparatus according to claim 12, wherein the multi-articulated coupling gear comprises:

a first stationary rotation axis, which extends parallel to the axis of rotation of the first and of the second counter-bending roller across the width of the strip;

an angle lever, provided with at least one force arm, the at least one force arm having one end rotatably mounted about the first stationary rotation axis and the at least one force arm engaged at an opposite end with the first adjusting device, and two load arms, the two load arms forming an angle $\alpha$ with the at least one force arm;

two extended levers arranged in mirror image to one another, each extended lever having a first end and a second end, wherein each extended lever is rotatably connected at the first end to an end of each of the two load arms opposite the first stationary rotation axis, and wherein each of the second ends carry and rotatably support the bending roller, and wherein the extended levers are respectively provided with a non-stationary pivot point that is positioned between the bending roller and an articulation of the angle lever; and two tabs arranged in mirror image to one another, each tab having a first end and a second end, wherein each first end is rotatably mounted at a pivot point of each of the two extended levers and each second end is rotatably mounted at a second stationary rotation axis, wherein the second stationary rotation axis of the tabs is arranged above the first stationary rotation axis of the angle lever.

14. The apparatus according to claim 1, wherein the second adjusting device and thus also the frame with the second counter-bending roller are controllable so that they are position-controlled and force-controlled.

* * * * *